United States Patent [19]

Schade, Jr.

[11] Patent Number: 4,853,610

[45] Date of Patent: Aug. 1, 1989

[54] PRECISION TEMPERATURE-STABLE CURRENT SOURCES/SINKS

[75] Inventor: Heinrich Schade, Jr., North Caldwell, N.J.

[73] Assignee: Harris Semiconductor Patents, Inc., Melbourne, Fla.

[21] Appl. No.: 279,885

[22] Filed: Dec. 5, 1988

[51] Int. Cl.[4] ..... G05F 3/28

[52] U.S. Cl. ..... 323/316; 323/907; 330/288

[58] Field of Search ..... 323/311, 312, 315, 316, 323/317, 271, 272, 907; 330/257, 288

[56] References Cited

U.S. PATENT DOCUMENTS

| | | | |
|---|---|---|---|
| 3,886,435 | 5/1975 | Steckler | 323/907 |
| 4,051,441 | 9/1977 | Wheatley | 330/288 |
| 4,055,811 | 10/1977 | Wheatley | 330/289 |
| 4,243,948 | 1/1981 | Schade | 330/289 |
| 4,262,244 | 4/1981 | Price, Jr. | 323/316 |
| 4,398,760 | 8/1983 | Neidorff | 330/288 |
| 4,500,831 | 2/1985 | Akram | 323/907 |
| 4,602,207 | 7/1986 | Kim et al. | 323/907 |
| 4,677,368 | 6/1987 | Bynum | 323/907 |
| 4,779,061 | 10/1988 | Matthies | 323/316 |

*Primary Examiner*—Peter S. Wong

*Attorney, Agent, or Firm*—Henry Schanzen; W. J. Shanley

[57] ABSTRACT

Programmable monolithic integrated circuit current mirrors configured as either current sources or current sinks include mixed MOS and bipolar technology on a substrate, wherein the master and slave elements each include a silicon-based emitter resistor having a positive temperature coefficient matched to the negative temperature coefficient of the $V_{be}$ of an associated bipolar transistor, for making the ratios of the master element current to the individual slave element currents substantially insensitive to dynamic temperature gradients produced in the associated substrate. Each slave is independently and individually compensated.

22 Claims, 3 Drawing Sheets

PRECISION TEMPERATURE-STABLE CURRENT SOURCES/SINKS

FIELD OF THE INVENTION

The present invention relates generally to amplifiers for providing current sources and current sinks, and more particularly relates to temperature stabilized monolithic integrated circuit current mirror amplifiers capable of serving as current sources and current sinks.

BACKGROUND OF THE INVENTION

Systems involving thermal printers or LED imaging, for example, often require accurately apportioned, temperature stable multiple current sources and/or sinks. Typically, it is preferred that such current sources and/or sinks be provided in integrated circuit form. Also, many of these and other types of systems require considerable logic-signal processing. The various functions required, along with low power consumption, are often provided by CMOS devices in combination with accurately matched output-current drivers. The latter components produce local thermal gradients on the silicon substrate, where the preferred integrated circuits are utilized. The thermal gradients often cause undesirable changes in the magnitudes of current flowing through various current sources or sinks located on the substrate. MOSFET technology is often used to attempt to satisfy applications requiring multiple current sources and/or sinks.

Known MOSFET current sources and sinks do not meet the operating requirements of many present applications, and do not provide a relatively high degree of accuracy in matching the magnitudes of the slave currents to the magnitude of the master current. In such integrated circuits, matching of devices on the integrated circuit chip varies with current density, with higher current densities generally providing better matching in the square-law region. However, such high-density operation requires the use of relatively large operating voltages, and relatively large positive gate-to-source voltage temperature coefficients pertain. Also, to minimize the required area on the silicon integrated circuit substrate, small channel lengths are typically used, which result in both poor matching and low dynamic output resistance (rout). As a result, the integrated circuit current mirror, for example, is very sensitive to load and supply voltage variations.

In many applications involving monolithic integrated circuit current mirrors for use as current sources or current sinks, such devices must also be programmable, typically in a digital fashion (programmably turned on or off). In such devices, the magnitudes of the output currents are significant, and local thermal gradients will vary throughout the chip, dependent upon the programming word applied at a given time for turning on or off various ones of the devices on the integrated circuit chip, or by some other power source causing varying thermal gradients on the integrated circuit substrate. As a result of the local thermal gradients, the accuracy of the current ratios or magnitudes is often diminished. Programmable monolithic integrated circuit current mirrors or sinks may include a large number (e.g. 84) of slave outputs. Such devices would require prohibitively complex interconnections within the integrated circuit should one attempt the normal practice of interdigitating devices throughout the chip, for obtaining temperature averaging, to reduce errors in slave current magnitudes due to the previously mentioned thermal gradients.

There have been many attempts in the prior art to reduce the effects of temperature gradients on the performance of transistor amplifiers, particularly integrated circuit current mirror transistor amplifiers. Examples of such prior attempts follows.

Schade, U.S. Pat. No. 4,243,948, entitled "Substantially Temperature-Independent Trimming of Current Flows", issued Jan. 6, 1981, teaches in an electronic device, a circuit including a positive-temperature-coefficient resistor and semi-conductor diode connected in parallel with a circuit for generating trim current. The latter circuit either consists of a relatively large, zero-temperature-coefficient adjustable resistance, or includes such a resistance connected in series with a zero-temperature-coefficient voltage source. In this manner, the trim for the current flow in the series-connected circuit is substantially unaffected by temperature gradients or changing temperature.

Wheatley, U.S. Pat. No. 4,051,441, entitled "Transistor Amplifiers", issued on Sept. 27, 1977, teaches in an NPN current mirror amplifier the use of emitter degeneration resistances that have temperature coefficients of $1/T_0$ for a range of temperatures around $T_0$. Each emitter degeneration resistance includes a current source in loop connection therewith for supplying substantially temperature-independent currents, respectively. At least one of the current sources is adjustable for changing the value of the current supplied to control the ratio of the collector currents of the first and second transistors, with the ratio being maintained substantially constant over a range of temperature changes in the vicinity of the transistors.

In Wheatley, U.S. Pat. No. 4,055,811, entitled =Transistor Amplifiers", issued Oct. 25, 1977, a transistor amplifier is disclosed in which the collector currents of first and second junction transistors, having base electrodes biased at the same quiescent potential, and emitter electrodes connected via a respective emitter degeneration resistance to a common point, are adjusted relative to each other by applying linearly temperature-dependent potentials to the latter, with at least one of the potentials being adjustable, for providing adjustment of the relative values of the collector currents that remains substantially unchanged over a range of temperature.

SUMMARY OF THE INVENTION

An object of the invention is to provide an improved programmable current mirror amplifier.

Another object of the invention is to provide monolithic integrated circuit current sources and/or sinks that are temperature stabilized.

With these and other objects, and in view of the problems in the prior art, the present invention comprises a current mirror amplifier configuration including master element means and a plurality of slave element means, wherein each of these elements includes a bipolar transistor driven by a MOSFET switch, with the emitter electrode of each one of the bipolar transistors of each element being connected through an associated emitter resistor to a common voltage rail. The negative temperature coefficient of the base-emitter voltage ($V_{BE}$) of each bipolar transistor is matched to the positive temperature coefficients of its associated emitter resistor, whereby a voltage drop is produced across the resistor which varies, as a function of temperature in a direction to fully compensate for the change in $V_{BE}$ resulting in a combination providing a zero temperature coefficient. Consequently, the magnitudes of individual currents flowing in each one of the slave elements remain in substantially constant proportion to one another, regardless of the programming of the MOSFET switches and varying temperature gradients throughout the common substrate.

BRIEF DESCRIPTION OF THE DRAWINGS

In the accompanying drawings, like elements are indicated by like reference designations, and.

DETAILED DESCRIPTION OF THE INVENTION

Figure 1:
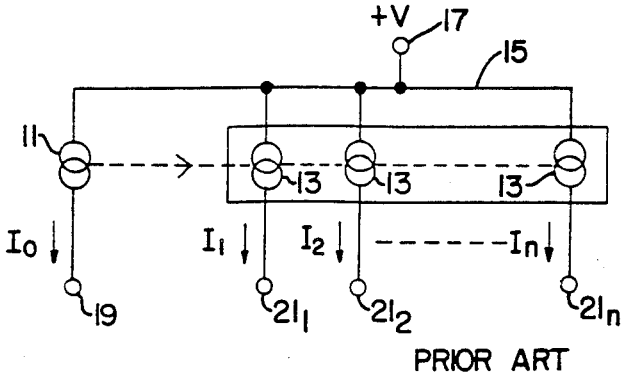
FIG. 1 is a schematic diagram showing a master and slave elements of a current-mirror amplifier.

In FIG. 1, a simplified current-mirror amplifier is shown including a master element 11, a plurality of slave elements 13, with one end of the master element 11 and slave elements 13 being connected in common to a positive voltage rail 15, connected via a voltage terminal 17 to a DC voltage source +V in this example. The other end of the master element 11 is connected to an input terminal 19. Similarly, the other ends of the slave elements 13 are connected to output terminals $\mathbf{21}_1$, $\mathbf{21}_2$, through $\mathbf{21}_n$. The terminals 19 and 21 may be connected to load impedances. Prior art monolithic integrated circuits typically provide the multiple current sources of the current-mirror configuration of FIG. 1 through use of PMOS devices, which devices are readily available via CMOS process technology. However, as previously indicated, such use of FET current sources or sinks are not practical for use in many applications. Further, when the slave elements 13 are operated in a programmable manner, typically via digital programming, in applications requiring relatively high magnitudes of master current $I_0$ and slave currents $I_1$, $I_2$, through $I_n$, in this example, local thermal gradients will dynamically change as the programming is changed for operating the slave elements $\mathbf{13}_1$-$\mathbf{3}_n$. As a result, as previously mentioned, the ratios of the current magnitudes between the master current $I_0$ and individual ones of the slave currents $I_n$ can not be maintained at desired levels.

Figure 2:
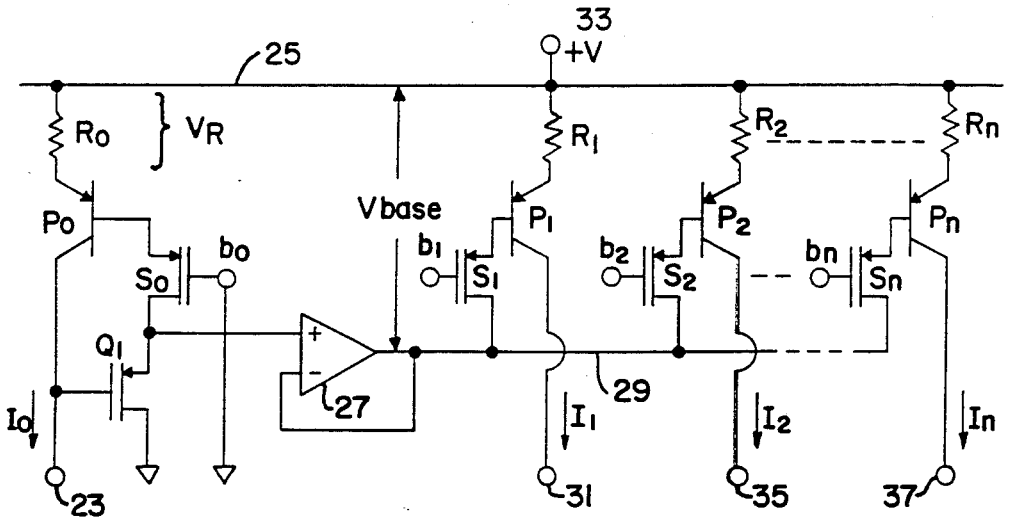
FIG. 2 is a circuit schematic diagram of one embodiment of the invention capable of being fabricated in monolithic integrated circuit form.

In one embodiment of the invention, as shown in FIG. 2, a circuit for a monolithic integrated circuit programmable current-mirror amplifier in a current source configuration is shown. As will be discussed, this configuration substantially eliminates the problems in the prior art. In the example of this embodiment, the master element includes a bipolar PNP transistor $P_0$ having a collector electrode connected (in common) to an input terminal 23 and to the gate electrode of a PMOS transistor $Q_1$. Also, transistor $P_0$ has an emitter electrode connected via an emitter resistor $R_0$ to a positive voltage rail 25, and a base electrode connected to the source electrode of a PMOS transistor $S_0$). The drain electrode of $S_0$ is connected to the source electrode of PMOS transistor $Q_1$, and to the non-inverting terminal of an operational amplifier 27. Also, the gate electrode of $S_0$ is connected via a programming terminal $b_0$ to a source of reference potential, ground in this example. The drain electrode of PMOS transistor $Q_1$ is connected to ground. The operational amplifier 27 is configured for unity gain via the connection of its non-inverting terminal to its output terminal, which is also connected to a common bus 29.

Each one of the three slave elements shown in FIG. 2 is connected in an identical configuration. For example, the first slave element includes a bipolar PNP transistor $P_1$ having a collector electrode connected to an output terminal 31, an emitter electrode connected via an emitter resistor $R_1$ to the positive voltage rail 25, for connection via a voltage terminal 33 to a source of DC voltage +V, and a base electrode connected to the source electrode of a PMOS transistor $S_1$. The PMOS transistor $S_1$ also has a drain electrode connected to the rail or bus 29, and a gate electrode connected to a programmable control terminal $b_1$. Similarly, the adjacent slave element includes an emitter resistor $R_2$, a bipolar PNP transistor $P_2$, and PMOS transistor $S_2$, a control or programmable terminal $b_2$, and an output terminal 35, all interconnected in the same manner as like elements of the previously mentioned slave element. Any number of slave elements can be similarly included on the monolithic integrated circuit substrate up to a practical limit. In this example, the highest number slave element, that is the nth slave element, includes an emitter resistor $r_n$, a bipolar PNP transistor $P_n$, a PMOS transistor $S_n$, a control and/or programmable terminal $b_n$, and an output terminal 37. As previously mentioned, within practical limits, n can be any integer number 1, 2, 3, 4, . . . to n.

In the simplest configuration for the embodiment of the invention of FIG. 2, the emitter resistors $R_0$, $R_1$, through $R_n$ are identical in value, and closely matched to one another. Accordingly, the ratios of the magnitudes of the master current $I_0$ to each one of the slave currents $I_1$, $I_2$, through $I_n$ will be substantially equal to one another. In more complicated configurations, the values of the emitter resistors $R_1$ through $R_n$ may purposely be made different in order to obtain different desired magnitudes of current $I_n$ for various ones of the slave elements, resulting in different current ratios between the master element and various ones of the slave elements. In either case, it is important that the predetermined current ratios between the master current $I_0$ and the slave currents $I_n$ be accurately maintained throughout a range of different temperature gradients on the substrate of the monolithic integrated circuit, caused by dynamically programming each one of the slave elements. In other words, at different times different ones of the slave elements may be turned on via operation of their associated PMOS transistor $S_n$ in accordance with desired programming of the current mirror amplifier configuration.

With further reference to FIG. 2, the operational amplifier 27 prevents excessive loading of the master element by the slave elements. The PMOS switches $S_0$ through $S_n$ provide substantially the same impedance in their main current paths for connection of their associated base electrodes to a common bus, when these PMOS transistors $S_0$–$S_n$ are turned on. The present inventor recognized that by using the PMOS transistors $S_0$ through $S_n$, which are integrated circuit transistors in this example, that the base-emitter offsets of these transistors can be more easily matched than the offsets occurring between the gate and source electrodes of field effect transistors, the latter presenting offset voltage errors that are often one to two orders of magnitude greater than those encountered using bipolar transistors. Also, bipolar transistors have superior stability relative to field effect transistors, and the former are easier to match from an input impedance standpoint.

The PMOS transistor $Q_1$ provides a buffer to conduct the base current of transistor $P_0$ supplied via the main conduction path of PMOS transistor $S_0$, to ground, in this example. In prior current mirror amplifier configurations, the base current of bipolar transistor $P_0$ would typically be added to the main current flow $I_0$ via a common connection between the base and collector electrodes of PNP transistor $P_0$. In the illustrated embodiment, through use of the buffer PMOS transistor $Q_1$ an advantage over prior configurations is obtained by preventing the base current of transistor $P_0$ from affecting the magnitude of the main current $I_0$. In this manner, $I_0$ is strictly a function of the collector-emitter current ($I_{CE}$) of transistor $P_0$. In this regard, the buffering provided by PMOS transistor $Q_1$ is similar to the buffering provided by the operational amplifier 27 for the previously mentioned slave elements. In applications where the base current demand is relatively low, it may be possible to eliminate the operational amplifier 27, by connecting bus 29 directly to the source electrode of PMOS transistor $Q_1$.

Many advantages are obtained in the present invention as illustrated in the embodiment of FIG. 2, through the use of the bipolar transistors $P_0$ through $P_n$, instead of the typically utilized MOSFET transistors. These advantages, some of which have been previously mentioned, include the relative stability of the base-emitter voltage offsets of the bipolar transistors, their lower and practically insignificant life drift, and lack of stability problems. Accordingly, the bipolar transistors $P_0$ through $P_n$ are substantially easier to match, relative to using MOSFET transistors. Also, if varying loads are placed on the slave elements, the resultant dynamic output impedance is often difficult to provide when MOSFET transistors are exclusively utilized. Through the use of bipolar transistors, as illustrated, necessary dynamic output impedance requirements can typically be more easily met. For example, MOSFET transistors would typically require very long and wide channels in order to obtain the required high output impedance. The silicon area on the monolithic integrated circuit substrate can be substantially reduced through the use of PNP transistors $P_0$ through $P_n$, as illustrated, relative to using PMOS transistors to obtain the same dynamic output impedance for the current mirror device. Through use of the bipolar transistors $P_0$ through $P_n$, matching can readily be accomplished through control of the relative values and characteristics of the emitter resistors $R_0$ through $R_n$, which provide high output impedance due to their emitter degeneration action.

As previously described, a major problem with programmable current mirror amplifiers serving as current sinks or current sources, is that the dynamic addressing of the slave elements of such amplifiers causes dynamic changes in the magnitudes of the currents flowing in different areas of the associated integrated circuit chip, in turn presenting a dynamic localized heating problem. The present invention, solves this problem by controlling the relationship between the emitter resistors $R_0$ through $R_n$ and their associated base-emitter offset voltages. The resistors have a positive temperature coefficient, whereas their associated PNP transistors have a negative temperature coefficient relative to the respective base-emitter voltage offsets.

In circuits embodying the invention as illustrated in FIG. 2, it is important that the respective master ($I_0$) and slave currents ($I_1$ through $I_n$) be relatively constant as a function of temperature.

To demonstrate how that is accomplished, note that the voltage ($V_R$) across any emitter resistor ($R_0$ through $R_n$) of value R may be expressed in terms of the operating voltage $V_{DD}$, the voltage ($V_B$) applied to the base of the bipolar transistor ($P_n$), and the base-to-emitter voltage ($V_{BE}$) and emitter current ($I_E$) of that transistor $P_n$, as follows in equations (1) and (2):

$$V_R = I_E R = (V_{DD} - V_B) - V_{BE} \quad (1)$$

$$I_E = \frac{V_{DD} - V_B - V_{BE}}{R} \quad (2)$$

For example, as the temperature increases, $V_{BE}$ (which has a negative temperature coefficient) decreases, causing the voltage ($V_R = V_{DD} - V_B - V_{BE}$) across an emitter resistor R to increase. However, R is made to have a positive temperature coefficient, whereby the value of R increases with temperature.

By appropriately selecting the temperature coefficient of the emitter resistor, the emitter current $I_E$ (and hence the collector current $I_C$) can be held relatively constant as a function of temperature of $V_{DD} - V_B = V_K$. The relationship between $V_{BE}$ and $V_R$ may be more precisely described, where $V_{DD}$-$V_B$ provides a constant voltage $V_K$ as a function of temperature, the following relationship should exist between $V_R$ and $V_{BE}$:

$$V_R + V_{BE} = V_K = V_{base} \text{ (volts)} \quad (3)$$

Differentially, $V_R$ may be set equal to $V_{BE}$.

The base-emitter offset potential of a bipolar transistor depends upon emitter current density but, for purposes of illustration may be approximated as follows:

$$V_{BE} = 1.2\text{-}2 \times 10^{-3} T \text{ (volts)} \quad (4)$$

The resistor voltage expression may be put in the following form:

$$V_R = IR(1 + \alpha \cdot \Delta T) \text{ (volts)} \quad (5)$$

Where $\alpha$ is the silicon resistor temperature coefficient. The sum may be expressed:

$$V_{base} = V_{BE} + V_R \quad \text{(volts)} \quad (6)$$

which at room temperature becomes:

$$V_{base0} = 1.2\text{-}2 \times 10^{-3} T_0 + IR_o \text{ (volts)} \quad (7)$$

and at $T_1$ is:

$$V_{base1} = 1.2\text{-}2 \times 10^{-3} T_1 + IR_0 + IR_0 (T_1 - T_0) \quad \text{(volts)} \quad (8)$$

For the required temperature insensitivity, $V_{base0} = V_{base1}$, and the equating of equations (7) and (8) yields:

$$IR_0 = 2 \times 10^{-3}/\alpha \text{ (volts)} \quad (9)$$

$$IR = 2000/\alpha(\text{volts}) \text{ where } \alpha \text{ is expressed in PPM/°C.} \quad (10)$$

Therefore, equation (7) may be expressed as:

$$V_{base} = 1.2\text{-}2\times 10_0^{-3}T + 2000/\alpha \text{ (volts)}, \quad (11)$$

which for $T_0 = 300°$ K. defines the required potential as:

$$V_{base} = 0.6 + 2000/\alpha \quad \text{(volts)} \quad (12)$$

By carefully controlling these relationships, the current magnitudes can be made essentially &temperature independent, and accurately maintained regardless of the number of slave elements being supplied current, that is regardless of the dynamic temperature gradients throughout the chip.

It is important that the silicon resistors $R_0$ through $R_n$ on the integrated circuit chip be closely thermally coupled to the base-emitter junctions of the associated PNP transistors $P_0$ through $P_n$, for maximizing the temperature compensation for obtaining a zero temperature coefficient in the current mirror amplifier. In effect, this makes the current mirror amplifier insensitive to variations in the temperature throughout the integrated circuit chip. Also, as previously explained, the addition of the buffer amplifiers $Q_1$ and operational amplifier 27 improves the current ratio accuracy of the present current mirror.

As previously mentioned, the embodiment of the invention shown in FIG. 2 provides a programmable monolithic integrated circuit current mirror amplifier that is programmable as to the slave elements, and substantially overcomes the problems in the prior art. The amplifier is fabricated in integrated circuit form via use of mixed MOS and bipolar technologies such as "BIMOS-E", for providing the high transconductance and well-matched base-emitter voltage offsets of bipolar devices, in addition to the stability and reliability of such devices over their product life. For purposes of explanation of the operation of the embodiment of FIG. 2, assume that the emitter areas of the bipolar transistors $P_0$ through $P_n$ are equal, and that the emitter resistors $R_0$ through $R_n$ are also equal in value and of good match relative to one another. A master-diode input current $I_0$ drawn from the master element bipolar transistor $P_0$ can be accurately reproduced by applying appropriate control signals to the control or input terminals $b_1$ through $b_n$ for turning on the PMOS switching transistors $S_1$ through $S_n$, respectively. In turn, this causes base current to be drawn from the bipolar transistors $P_1$ through $P_n$, respectively, for turning on these transistors to provide the respective collector currents as output slave currents $I_1$ through $I_n$, in this example. As previously mentioned, the control signals applied to the controller input terminals $b_1$ through $b_n$ can be programmed for selectively turning on the PMOS switches $S_1$ through $S_n$, for selectively providing the output or slave currents $I_1$ through $I_n$.

The buffer amplifier 27 is configured to have a gain of I, as previously mentioned, and is selected for providing a low millivolt (bipolar) input offset, for supplying the required range of base drive for the bipolar transistors $P_1$ through $P_n$ of the slave elements. Buffer 27 supplies this base drive requirement regardless of the programmed word written on the control terminals $b_1$ through $b_n$, without a significant input differential voltage change. Also, control terminal $b_0$ is directly connected to a source of reference potential, in this example ground, for providing a continuous "low" or "digital 0" signal at this terminal, in order to compensate for the voltage drops occurring across the slave switches $S_1$ through $S_n$ when turned on.

In practice, the embodiment of the invention of FIG. 2 functions well at any one uniform silicon temperature with a high output impedance $r_{out}$, whenever $V_R$ (the voltage dropped across $R_0$) is substantially greater than KT/q, where K is the Boltzman's constant $1.38\times 10^{-23}$ Joules/°K, T is the temperature in degrees Kelvin, and q is the charge equal to $1.6\times 10^{-19}$ Coulombs. If this design criteria is met, the present circuit provides substantially high immunity to load and supply voltage changes with only a marginal loss of "overhead voltage" across the emitter resistor $R_0$.

In the preferred embodiment of the circuit of FIG. 2, it is important that the voltage $V_{base}$ between the positive rail 25 and the output of the buffer amplifier 27 (see FIG. 2) is made up of the sum of the base-emitter voltage $V_{BE}$ of bipolar transistor $P_0$ and the voltage (shown as $V_R$ in FIG. 2) developed across the emitter-resistor $R_0$ plus the source-drain drop of the $S_i$ transistors, which for purposes of illustration is assumed to be zero. The value of $V_{base}$ is chosen for obtaining a negative temperature coefficient for the base-emitter voltage of bipolar transistor $P_0$ equivalent to the quantity $[1.2\text{-}2(10^{-3}T)]$ volts, and is balanced by the positive temperature coefficient $V_R$ of the emitter-resistor $R_0$ equivalent to the quantity $[IR(1+\alpha T)]$, where "I" the magnitude of current firing through $R_0$, $\alpha$ is the temperature coefficient of the silicon based resistor, T is the temperature in degrees Kelvin, and $V_R$ is the voltage related temperature coefficient of the diffused/implanted silicon resistor $R_0$, in this example. The same design criterion is used for equating the $V_{BE}$ of each one of the slave bipolar transistors $P_1$ through $P_n$, to the voltage across their respective emitter resistors $R_1$ through $R_n$, respectively, where each one of these resistors are diffused/implanted silicon resistors, in this example. In this manner, the effects of thermal gradients or local heating across the silicon substrate in the vicinity of the included bipolar transistors $P_0$ through $P_n$, in this example, and their associated emitter resistors $R_0$ through $r_n$, respectively, will not substantially cause changes in the magnitudes of the source $I_0$ and output currents $I_1$ through $I_n$. In other words, regardless of the programming for selectively turning on different ones of the slave elements of the embodiment of FIG. 2, at different times the resultant changes in current flow through various regions of the substrate, causing dynamic thermal gradients, will not substantially effect the desired magnitudes of the output currents $I_1$ through $I_n$.

Figure 3:
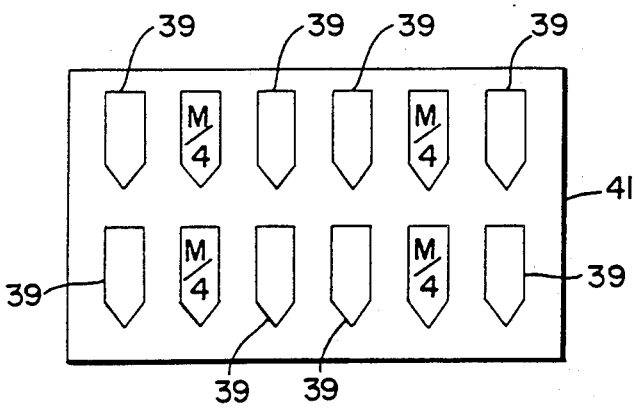
FIG. 3 is a block diagram showing another embodiment of the invention.
Figure 4:
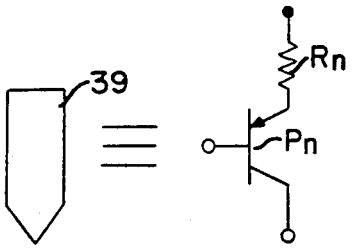
FIGS. 4 and 5 show details of portions of the slave and master elements of FIG. 3.
Figure 5:
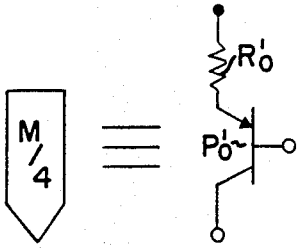

In the preferred embodiment, in order to produce well matched source currents $I_1$ through $I_n$, which are accurately maintained in the desired ratio to the magnitude of the master current $I_0$, it is necessary to distribute or interdigitate portions of the structure of the silicon resistor $R_0$ and the bipolar transistor $P_0$ throughout the source array. Such partial interdigitating is substantially less complicated and expensive than attempting to interdigitate all of the slave elements and the master element with one another for applications requiring from 64 to 80 slave elements, for example. For purposes of illustration, FIG. 3 shows such interdigitation for the programmable current mirror of FIG. 2 including eight slave elements 39 on a substrate 41, with the master element $P_0$ and $R_0$ structure interdigitated at four locations on the substrate 41. Each of these interdigitated master element structures are indicated by the reference "M/4". As shown in FIG. 4, the slave element portions 39 at least include the silicon based resistors $R_n$ and bipolar transistors $P_n$. Also, as shown in FIG. 5, the interdigitated master element portions "M/4" each include a PNP transistor $P'_0$ of $\frac{1}{4}$ $P_0$ emitter area, and a silicon-based emitter resistor $R'_0$, where the value of $R'_0$ equal to four times the resistance of $R_0$. When the four interdigitated elements "M/4" are connected in parallel on the substrate 41, the master bipolar $P_0$ and emitter resistor $R_0$ structure are obtained. Such interdigitation substantially improves the accuracy of the median ratio between master and slave currents.

For typical resistor temperature coefficients for $R_0$ through $R_n$ in the range of 3,000 to 5,000 PPM/° C., the 20° C. ambient value of the voltage $V_R$ across resistor $R_0$ is slightly lower than the base emitter voltage $V_{BE}$ of bipolar transistor $P_0$, typically 500 mv for 4,000 PPM/°C. This degree of emitter degeneration produces about 20 times the usual output impedance $r_{out}$ of the bipolar transistor $P_0$, typically yielding 400.0 to 1,000.0 volts early voltage.

Figure 6:
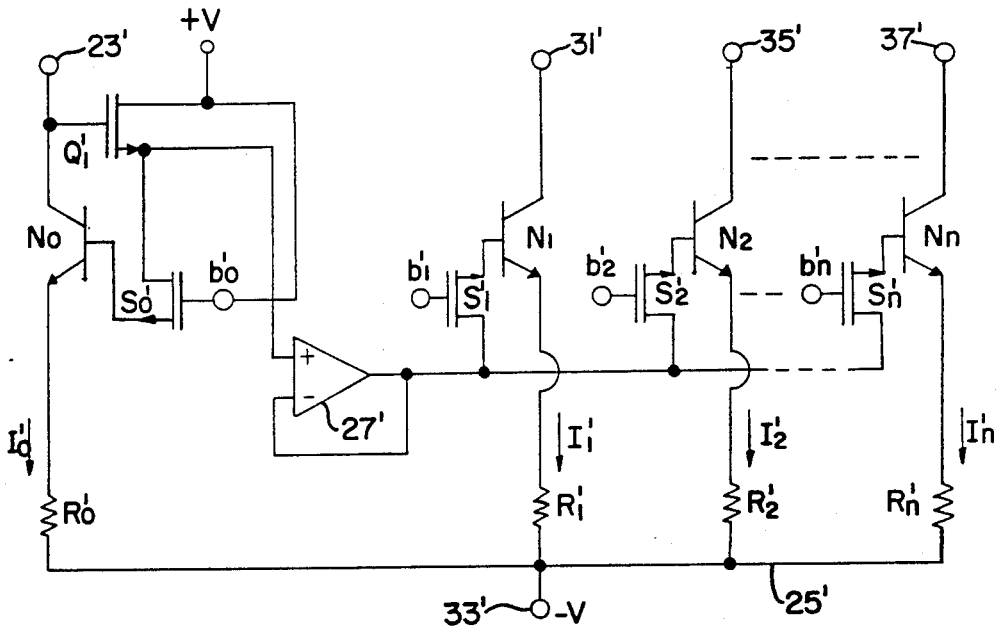
FIG. 6 is a circuit schematic diagram of yet another embodiment of the invention.

In FIG. 6, the complement of the circuit of FIG. 2 is shown, including NPN sink transistors $N_0$ through $N_n$. Also, NMOS switching transistors $S'_0$ through $S'_n$ are included as shown. The buffer switching transistor $Q_1$ has also been made an NMOS transistor. The emitter resistors for this complementary array are shown as $R'_0$ through $R'_n$. Also, the sink currents are shown as $I'_0$ through $I'_n$. Note that the buffer amplifier 27' is identically configured to the buffer amplifier 27 of the embodiment of FIG. 2. The emitter resistors $R'_0$ through $R'_n$ are terminated to a negative rail 25' for connection via a voltage terminal 33' to a source of DC voltage, −V volts in this example. The negative rail 25' may in different applications be terminated to a source of reference potential, such as ground, for example, or some voltage below ground, as shown. Also, the control terminals are shown as $b'_0$ through $b'_n$, respectively. In the embodiment of FIG. 6, a programmable current mirror providing a current sink for a plurality of loads or devices is provided. The operation of this complementary embodiment to that of FIG. 2 operates in substantially the same manner as the embodiment of FIG. 2, with the exception that the latter provides a current source configuration, as previously described. Also, note that the master diode currents $I_0$ in the embodiment of FIG. 2, and $I'_0$ of the embodiment of FIG. 6 can be readily controlled with a bandgap reference with a "loop current" externally programmed by a zero temperature coefficient resistor, as previously described.

Although various embodiments of the invention have been described herein for purposes of illustration, other embodiments may be apparent to those of skill in the art. It is well know, for example, that resistors placed in series with the base electrode of the FIGS. 4 and 5 elements $P_n$, $P'_o$, respectively, can reduce loading of the base bus and amplifier 27 and 27', respectively, should an output terminal saturate due to a load failure. Such other embodiments are also meant to be within the spirit and scope of the invention as claimed in the appended claims.

I claim:

1. A monolithic integrated circuit comprising:

a substrate;

a plurality of bipolar transistors, each having emitter, base, and collector electrodes formed on said substrate;

a plurality of resistors, one resistor per bipolar transistor; said resistors having similar thermal characteristics; each resistor being connected between the emitter of its corresponding bipolar transistor and a common voltage rail; and each resistor being formed on said substrate in a tight thermal connection with the base-emitter junction of its corresponding bipolar transistor; each one of said resistors having a positive temperature coefficient to produce a voltage at a given current level, which varies in a direction to fully compensate for the negative temperature coefficient of the base-to-emitter voltage of its corresponding bipolar transistor, thereby making the magnitudes of current flowing between the collector and emitter electrodes of said plurality of bipolar transistors, substantially independent of temperature; and means formed on said substrate for connecting said plurality of bipolar transistors and resistors in a current mirror configuration of a master element and a plurality of slave elements.

2. The integrated circuit of claim 1, wherein said means formed on said substrate for connecting includes:

maser element connecting means including:

a first MOSFET transistor having a main current path with one end connected to a base electrode of one of said plurality of bipolar transistors, and a gate electrode connected to a source of reference potential; and means for coupling the other end of said main current path of said first MOSFET transistor to the collector electrode of said one bipolar transistor; and slave element connecting means including:

a plurality of second MOSFET transistors each having a main current path connected at one end to a base electrode of the individual other ones of said plurality of bipolar transistors, respectively, and a gate electrode for receiving an individual control signal for selectively turning on the associated said second MOSFET transistor, the other ends of the main current paths of said second MOSFET transistors being connected together; and means for coupling the commonly connected other ends of the main current paths of said second MOSFET transistors to the base electrode of said one of said plurality of bipolar transistors.

3. The amplifier of claim 2, wherein said coupling means of said master element connecting means includes:

a third MOSFET transistor having a gate electrode connected to the collector electrode of said one bipolar transistor, and a main current path connected between the other end of the main current path of said first MOSFET transistor and a source of reference potential.

4. The amplifier of claim 3, wherein said coupling means of said slave element connecting means includes a unity gain amplifier having an input terminal connected to the common connection between the main current paths of said first and third MOSFET transistors, and an output terminal connected to the common connection of the other ends of the main current paths of said plurality of second MOSFET transistors.

5. The amplifier of claim 3, wherein said coupling means of said slave element connecting means includes an operational amplifier connected for unity gain, having a noninverting terminal connected to the common connection between the main current paths of said first and third MOSFET transistors, an inverting terminal and an output terminal connected in common to the other ends of the main current paths of said plurality of second MOSFET transistors.

6. The amplifier of claim 2, wherein at least said one of said plurality of bipolar transistors, and the associated one of said plurality of resistors included in said master element are interdigitated amongst said slave elements on said substrate, for reducing thermal effects upon the ratios of the current magnitudes between said master element and slave elements.

7. The amplifier of claim 2, wherein the ratio of the magnitude of current flowing through said master element to the magnitude of current flowing through a given one of said slave elements, is determined by the values of the ones of said plurality of resistors associated with said master element and said one slave element.

8. A current mirror amplifier, comprising:

a master element including a MOS switching transistor means for both electrically connecting base and emitter electrodes of a bipolar transistor, and driving said base electrode, for turning on said bipolar transistor to supply a master current through a main current path of said bipolar transistor, said bipolar transistor also including a base-emitter junction having a negative temperature coefficient for the voltage developed thereacross, and a resistor connected between an emitter electrode of said bipolar transistor and a voltage rail, said resistor being tightly thermal coupled to said baseemitter junction, and having a positive temperature coefficient for balancing the negative temperature coefficient of said baseemitter junction, thereby making the magnitude of said master current substantially independent of variations in temperature about said master element;

a plurality of slave elements each including a MOS switching transistor having a gate electrode for receiving a control signal for turning on said MOS switching transistor, for substantially reducing the impedance of a main current path thereof, one end of which is connected to a base electrode of a bipolar transistor, said bipolar transistor including a baseemitter junction having a negative temperature coefficient for the voltage developed thereacross, and a resistor connected between an emitter electrode of said bipolar transistor and said voltage rail, said resistor being tightly thermal coupled to said base-emitter junction, and having a positive temperature coefficient chosen for balancing the negative temperature coefficient of said base-emitter junction, thereby making the magnitude of a slave current flowing through a main current path of said bipolar transistor when turned on, substantially independent of temperature variations about said slave elements; and coupling means for connecting the other ends of the main current paths of said MOS switching transistors of said plurality of slave elements to said base electrode of said bipolar transistor of said master element.

9. The current mirror amplifier of claim 8, wherein said MOS switching transistor means of said master element further includes:

a first MOS switching transistor having a gate electrode connected to a source of reference potential, and a main current path with one end connected to said base electrode of said bipolar transistor; and a second MOS switching transistor having a gate electrode connected to said collector electrode of said bipolar transistor, and a main current path connected between the other end of said main current path of said first MOS switching transistor and another source of reference potential, for providing a current path for base current between said bipolar transistor and said source of reference potential, thereby preventing the base current from combining with and influencing the magnitude of current flowing through the collector-emitter current path of said bipolar transistor.

10. The current mirror amplifier of claim 9, wherein said coupling means includes a unity gain buffer amplifier having an input terminal connected to the common connection between the main current paths of said first and second MOS transistors of said master element, and an output terminal connected in common to the other ends of said MOS switching transistors of each one of said plurality of slave elements, for preventing base current from said slave elements from loading down said master element.

11. The current mirror amplifier of claim 9, wherein said coupling means includes an operational amplifier having a non-inverting terminal connected to the common connection between the main current paths of said first and second MOS switching transistors of said master element, an inverting terminal directly connected in common to an output terminal of said operational amplifier, and to the other ends of said MOS switching transistors of each one of said plurality of slave elements.

12. The current mirror amplifier of claim 8, further including the combination of at least said emitter resistor and bipolar transistor being interdigitated throughout portions of said slave elements upon a common substrate on which said master and slave elements are formed, for maintaining an accurate median ratio between the current associated with said master and slave elements.

13. A temperature stabilized current mirror amplifier for providing a plurality of current sources or sinks comprising:

a voltage terminal for receiving a DC supply voltage;

a load terminal for connection to a predetermined load;

a first bipolar transistor having emitter, base, and collector electrodes, said collector electrode being connected to said load terminal;

a first resistor connected between said emitter electrode and said voltage terminal, said first resistor having a positive temperature coefficient chosen for substantially compensating fcr a negative temperature coefficient related to a semiconductor junction formed between said base and emitter electrodes, for substantially providing a zero temperature coefficient between the base of said first transistor and said voltage terminal;

first and second MOSFET transistors having respective main current paths connected in series between said base electrode of said first bipolar transistor and a source of reference potential, one end of the main current path of said first MOSFET being connected to said base electrode, a gate electrode of said first MOSFET being connected to said source of reference voltage, and a gate electrode of said second MOSFET being connected to said collector electrode;

a plurality of second bipolar transistors having emitter, base, and collector electrodes;

a plurality of second resistors each of which is connected between individual emitter electrodes of said second bipolar transistors, respectively, and said voltage terminal, said second resistors being substantially matched to one another and said first resistor relative to temperature coefficient and accuracy, said second resistors having a positive temperature coefficient related to the voltage developed between the base and emitter electrodes of the associated ones of said second bipolar transistors, respectively, for substantially providing a zero temperature coefficient across the combination;

programmable means for selectively coupling individual ones of the base electrodes of said second bipolar transistors to the common connection between the main current paths of said first and second MOSFET transistors; and a plurality of output terminals connected to individual ones of the collector electrodes of said second bipolar transistors, respectively;

the combination of said first bipolar transistor, first resistor, and first and second MOSFET transistors providing a master element for said current mirror;

the combinations of said given ones of said second bipolar transistors, and second resistors, respectively, with said programmable means providing a plurality of slave elements for said current mirror amplifier.

14. The current mirror amplifier of claim 13, wherein said programmable means includes:

a plurality of third MOSFET transistors each having a main current path connected at one end to an individual base electrode of said plurality of second bipolar transistors, respectively, the other ends of the main current paths being connected to a common bus, and each of said third MOSFET's having a gate electrode;

coupling means for connecting the common connection between the main current paths of said first and second MOSFET transistors to the common bus connecting together the other ends of the main current paths of said plurality of third MOSFET transistors; and a plurality of control terminals connected to individual ones of the gate electrodes of said plurality of third MOSFET transistors, respectively, for receiving control signals for selectively turning on said third MOSFET transistors, for causing associated ones of said second bipolar transistors to turn on.

15. The current-mirror amplifier of claim 14, further including a substrate upon which are formed said master and slave elements as a monolithic integrated circuit.

16. The current-mirror amplifier of claim 15, wherein at least said first bipolar transistor and first resistor of the master element are interdigitated amongst said slave elements, for substantially improving the thermal operating characteristics of said current-mirror amplifier.

17. The current mirror amplifier of claim 15, wherein said first resistor is tightly thermal coupled to a base emitter junction of said first bipolar transistor, and said plurality of second resistors are each tightly thermal coupled to baseemitter junction of their associated one of said plurality of said second bipolar transistors.

18. The current-mirror amplifier of claim 14, wherein said coupling means includes a unity gain amplifier having an input terminal connected to the common connection between the main current paths of said first and second MOSFET transistors, and an output terminal connected to the common bus connecting together the other ends of the main current paths of said plurality of third MOSFET transistors.

19. The current mirror amplifier of claim 14, wherein said coupling means includes an operational amplifier having an inverting terminal connected to the common connection between the main current paths of said first and second MOSFET transistors, a non-inverting terminal connected in common to an output terminal thereof, and to the common connection of the other ends of the main current paths of said plurality of third MOSFET transistors.

20. The current-mirror amplifier of claim 14, wherein said first and second bipolar transistors each consist of PNP transistors, said first through third MOSFET transistors each consist of PMOS transistors, and said voltage terminal is for connection to a positive DC voltage supply, for configuring said current mirror for providing a plurality of programmable current sources.

21. The current-mirror amplifier of claim 14, wherein said first and second bipolar transistors each consist of NPN transistors, said first through third MOSFET transistors each consist of NMOS transistors, and said voltage terminal is for connection to a negative DC voltage supply, for configuring said current mirror for providing a plurality of programmable current sinks.

22. A temperature stabilized current-mirror amplifier comprising:

a first bipolar transistor having base, emitter, and collector electrodes, said base and collector electrodes being connected together;

a first resistor connected between the emitter electrode of said first bipolar transistor and a voltage bus, said first resistor having a positive temperature coefficient matched to compensate for the negative temperature coefficient of the base-to-emitter voltage of said first bipolar transistor, said first resistor and first bipolar transistor forming a master element of said current mirror;

a second bipolar transistor having a base electrode connected to the common connection of said base and collector electrodes of said first bipolar transistor, an emitter electrode, and a collector electrode; and a second resistor connected between the emitter electrode of said second bipolar transistor and said voltage bus, said second resistor having a positive temperature coefficient matched to compensate for the negative temperature coefficient of the voltage developed across the base and emitter electrodes of said second bipolar transistor.

* * * * *